US006467714B1

(12) United States Patent
Rasmussen

(10) Patent No.: US 6,467,714 B1
(45) Date of Patent: Oct. 22, 2002

(54) WINDING MECHANISM FOR ROLLER BLINDS

(75) Inventor: Ken Rasmussen, Ringe (DK)

(73) Assignee: A/S Chr. Fabers Fabriker, Ryslinge (DK)

( * ) Notice: Subject to any disclaimer, the term of this patent is extended or adjusted under 35 U.S.C. 154(b) by 0 days.

(21) Appl. No.: 09/463,094

(22) PCT Filed: Jul. 7, 1998

(86) PCT No.: PCT/DK98/00318

§ 371 (c)(1),
(2), (4) Date: May 10, 2000

(87) PCT Pub. No.: WO99/04126

PCT Pub. Date: Jan. 28, 1999

(30) Foreign Application Priority Data

Jul. 16, 1997 (DK) ..... 0871/97
Jan. 9, 1998 (DK) ..... 0023/98

(51) Int. Cl.[7] ..... B65H 75/30; E06B 9/42

(52) U.S. Cl. ..... 242/381; 160/296; 160/299; 160/305

(58) Field of Search ..... 242/381, 396.9, 242/381.5, 396; 160/296, 299, 315, 318, 305

(56) References Cited

U.S. PATENT DOCUMENTS

| | | | | | |
|---|---|---|---|---|---|
| 873,438 | A | * | 12/1907 | John | 160/292 |
| 1,944,454 | A | * | 1/1934 | Park | 160/265 |
| 4,523,620 | A | * | 6/1985 | Mortellite | 160/315 |
| 4,836,263 | A | * | 6/1989 | Ament | 160/68 |
| 5,437,324 | A | * | 8/1995 | Sternquist | 160/299 |
| 5,439,200 | A | * | 8/1995 | Braesch et al. | 254/267 |
| 5,788,478 | A | * | 8/1998 | DeNoia et al. | 431/253 |

* cited by examiner

*Primary Examiner*—Donald P. Walsh
*Assistant Examiner*—J Rodriguez
(74) *Attorney, Agent, or Firm*—Pearne & Gordon LLP

(57) ABSTRACT

A roller for a roller blind in the shape of a tube (T) comprising a mechanism known per se is braked by means of friction, in that a compression spring (7) is compressed when the blind is pulled down and establishes a force between a collar (6) on the non-rotating rod (2) of the roller blind, and a nut (8) which is rotated by the tube. The nut has a shoulder **(8*a*) which cooperates with a corresponding shoulder (14)** at the end of the non-rotating rod. An alternative spring force is obtained by means of a piston in an air cylinder in which a calibrated exhaust opening for the air reduces the braking action when rotation is slow.

6 Claims, 6 Drawing Sheets

Fig.5a
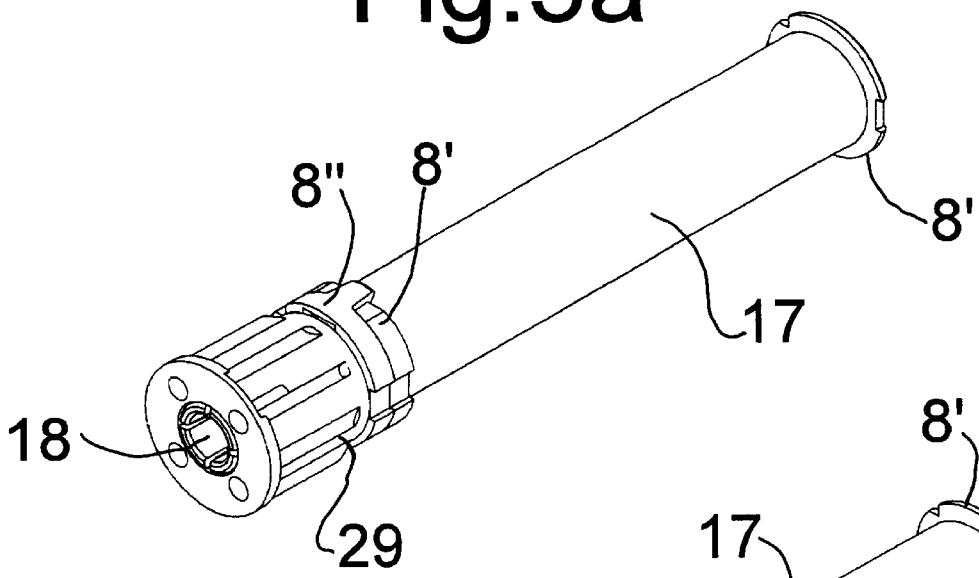
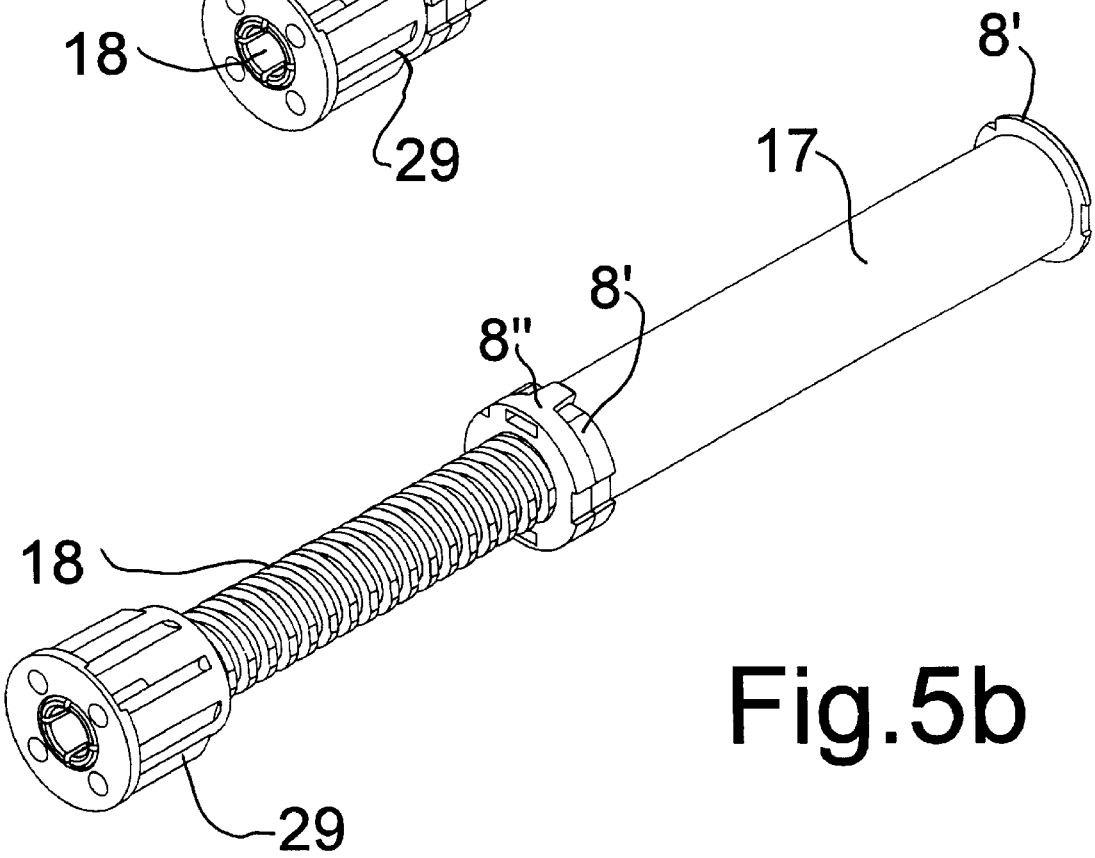
Fig.5b

WINDING MECHANISM FOR ROLLER BLINDS

BACKGROUND OF THE INVENTION

The invention relates to a winding mechanism for roller blinds which are rolled onto a tube, of the kind in which a stationary rod inside the tube is held by an external fixture, one end of the tube being rotatably supported on the rod by means of a bearing sleeve, and in which a rotational force is created between the rod and the tube.

Such winding mechanisms are well known, and they have the following general features: The spring is tensioned when the blind is pulled down, and a latching device blocks the roller blind at desired adjustments. The construction provides an advantageous characteristic, because the force of the spring is at its maximum when the tube has to carry the largest length of hanging blind. When the latching device is freed by means of a sharp pull in the blind the roller blind is wound around the tube during a strong acceleration. When it has reached the top it has obtained the highest speed, and means have been provided to brake the bottom rail when it has been completely raised. It is important that the fully wound roller blind does not participate in the rotation, because this would relax the spring, so that the bottom rail would end dangling at an undefined height below the desired position. Because of this, the bottom rail is frequently stopped by means of its dimensions or by means of a projection fitted to the bottom rail. However, the sharp braking is harmful, both for the roller blind and seams provided in it, and for the window frame which receives beatings from the projections. It is under all circumstances desirable that the spring has a minimum bias when the roller blind is in its uppermost position.

Various braking devices have been tried to prevent the strong acceleration towards the fully wound condition, but a stationary friction must not be so large that the spring cannot overcome it by means of its least tension, and this means that the spring must be stronger and the action of the brake will be very dependent on a precise balancing of the remaining tension of the spring and the friction. A further problem arises in case the blind is made in a comparatively stiff fabric which has a memory effect relating to the position it has taken for some appreciable time. Hereby a force which would be suitable for winding from a particular starting position, would be unsuitable when starting from another starting position.

It has been suggested to use a centrifugal regulator in which weights are flung outwards due to the rotation of the tube and create friction, so that a speed-dependent braking is obtained. This is evidently desirable, however it is a solution which is mechanically very complicated, because the small rotational radius requires a high rotational speed to obtain a braking effect. One is required to use a gear train which can transform the rotational speed of the tube to a far higher rotational speed which inside a tube is usually performed by means of a multistage planetary drive. This calls for a large number of parts, some of which will rotate quickly which causes wear problems. Furthermore a unilateral clutch is required to disengage the brake and gear during lowering of the blind. This type of solution will not stop the blind in its uppermost position and prevent its relaxing the spring.

SUMMARY OF THE INVENTION

There is hence a need for a simple and stable solution which in connection with a roller blind may provide a controlled raising and stopping of the roller blind in its uppermost position which influences neither the roller blind itself nor its window frame surroundings.

This is obtained in a mechanism according to the invention which is particular in that a non-rotating threaded rod cooperates with a nut which is rotated by the tube during axial shifting, and in which an elastic axial force is created which at least during a fast movement in a first direction is increased due to the movement of the nut, and in which elements have been provided which establish a controlled friction against the rotation of the nut.

The axial force may be provided either by means of a helical spring or by means of a piston which acts on a volume of air in a cylinder.

It will have been noted that as the rod is non-rotating, a nut which is rotated will be simultaneously shifted axially. The rotation of the nut is e.g. created by means of a groove- and tounge connection between the inside of the tube and the outside of the nut, and the nut will move in a direction which either compresses the spring or relaxes it. The spring force basically establishes friction in three locations: 1) between the nut and the thread, 2) between one end of the spring and the nut, and 3) between the other end of the spring and a suitable shoulder. The well controlled friction may be created one of these places, unless particular elements are provided for this purpose, in which case the two locations last mentioned may be made into firm connections.

One embodiment is particular in that the elastic force is provided by means of a piston which acts against a closed volume of air in a cylinder. By providing a controlled exhaust of the air from the cylinder, any desired compression spring characteristic may be dynamically obtained, as it will have been noted that the greatest problem of braking occurs when the roller blind is fast rotating, whereas there is a need for sufficient spring force to obtain correct raising during slow rotation, where there is no stored energy due to the moment of inertia.

In this embodiment there are four possibilities of creating friction due to the axial spring: 1) between the nut and the thread, 2) between one end of the air cylinder spring and the nut, 3) between the other end of the air cylinder spring and a suitable shoulder, and 4) between the piston and the cylinder in the air cylinder spring. The well controlled friction may be created one of these places, unless particular elements are provided for this purpose, in which case the two locations last mentioned may be made into firm connections. The adjustment of the characteristic of the air cylinder spring, because it becomes dependent on whether the movement of the piston is able to build up a pressure which causes braking (fast rotation) in accordance with the calibration of an exhaust opening for air. During slow rotation, the air will be able to exhaust in time with its compression. Hereby the same advantages as those obtained in the mechanically complex centrifugal regulator are obtained in a simple manner. It would similarly be possible to change the spring characteristic as a function of the precise position of the roller blind, because several calibrated exhaust openings may be provided along the inner surface of the cylinder. As the air inside the cylinder is lost in use, a new volume is needed for each lowering, and it is hence expedient to provide an in-flow valve for the air during reversed axial movement.

One embodiment is particular in that the rod is divided into two parts by means of a separating shoulder, one of which is provided with a thread onto which is fitted a nut which is given a rotation during sideways movement by the tube, and in which a compression spring is provided between the shoulder and the nut. The place of friction 3 will be provided by the shoulder. This construction is also well adapted for the air cylinder spring discussed above.

An advantageous embodiment is particular in that the friction is established between the nut and the thread, the support of the compression spring on the nut, alternatively on the shoulder being reduced in friction. In this case an axial ball bearing or similar bearing may be provided between the spring and one of its supports. This construction is equally well adapted for use with the air cylinder spring discussed above.

A further advantageous embodiment is particular in that the friction is established by means of the support of the compression spring on the nut, alternatively on the shoulder, the connection between the thread and the nut being reduced in friction. In this case the preparation of one end of the spring or a suitable shoe ensures the well controlled friction. In this case the thread and nut may be made in low-friction materials, or a nut with recirculating balls may be used. This construction is equally well adapted for use with the air cylinder spring discussed above.

In order to prevent that the nut wedges itself into a lock at the remote end (with the spring expanded) during braking, care is taken that the rotation is stopped while the thread still has a controlled or negligible friction. This is advantageously obtained in that the nut is provided with an abutment at the periphery for interacting with a further shoulder at the end of the thread which stops the rotation of the nut before its movement is blocked by hitting the shoulder axially. It is hence a rotating and not an axial movement which performs the stopping. This blocked position corresponds to the uppermost position of the roller blind and is adjusted during fitting. This construction is particularly useful in conjunction with the use of an air cylinder spring.

In a further advantageous embodiment the support of the compression spring on the shoulder has a reduced friction in that the shoulder is constituted of the bearing sleeve of the rod, the compression spring being supported between the sleeve and the nut. In this case the compression spring is completely surrounding also the raising spring, and it must hence be considerably longer. Thereby a bearing with reduced friction is completely eliminated, because the spring is now only subjected to axial forces, it follows the rotation, because it is supported between the bearing which at one end rotates around the non-rotating rod and the nut which follows the rotation. Thereby there will also be a smaller variation in the force of the spring because of reduced percentage-wise variation in the length of the compression spring.

A further embodiment is particular in that the helical compression spring is supported between a plug with a bearing journal and the nut.

BRIEF DESCRIPTION OF THE

A further embodiment further develops this solution and is particular in that the threaded rod is taken through the plug and is fixed against rotation by means of a fixture independent of the clamping of the rod for the raising spring. This means that the fixture at the opposite end of the roller blind, which traditionally has a bearing for a journal, will be made to hold the threaded rod against rotation in similarity with the fixture discussed in the introduction of the description.

The invention will be described in greater detail with reference to the drawing, in which FIG. 1*a* shows embodiment of the invention in dimetric projection, FIG. 1*b* shows the same embodiment of the invention in the position in which the raising spring has its weakest force and in which the nut has stopped the movement according to the invention, FIG. 2 shows a longitudinal section through an embodiment of the invention corresponding to FIG. 2, FIGS. 3A and 3B shows an air cylinder spring according to a different embodiment of the invention.

FIGS. 5A and 5B show the air cylinder spring of FIGS. 3A and 3B, with associated structure.

DESCRIPTION OF EXAMPLE EMBODIMENTS

Figures 1A, 1B:
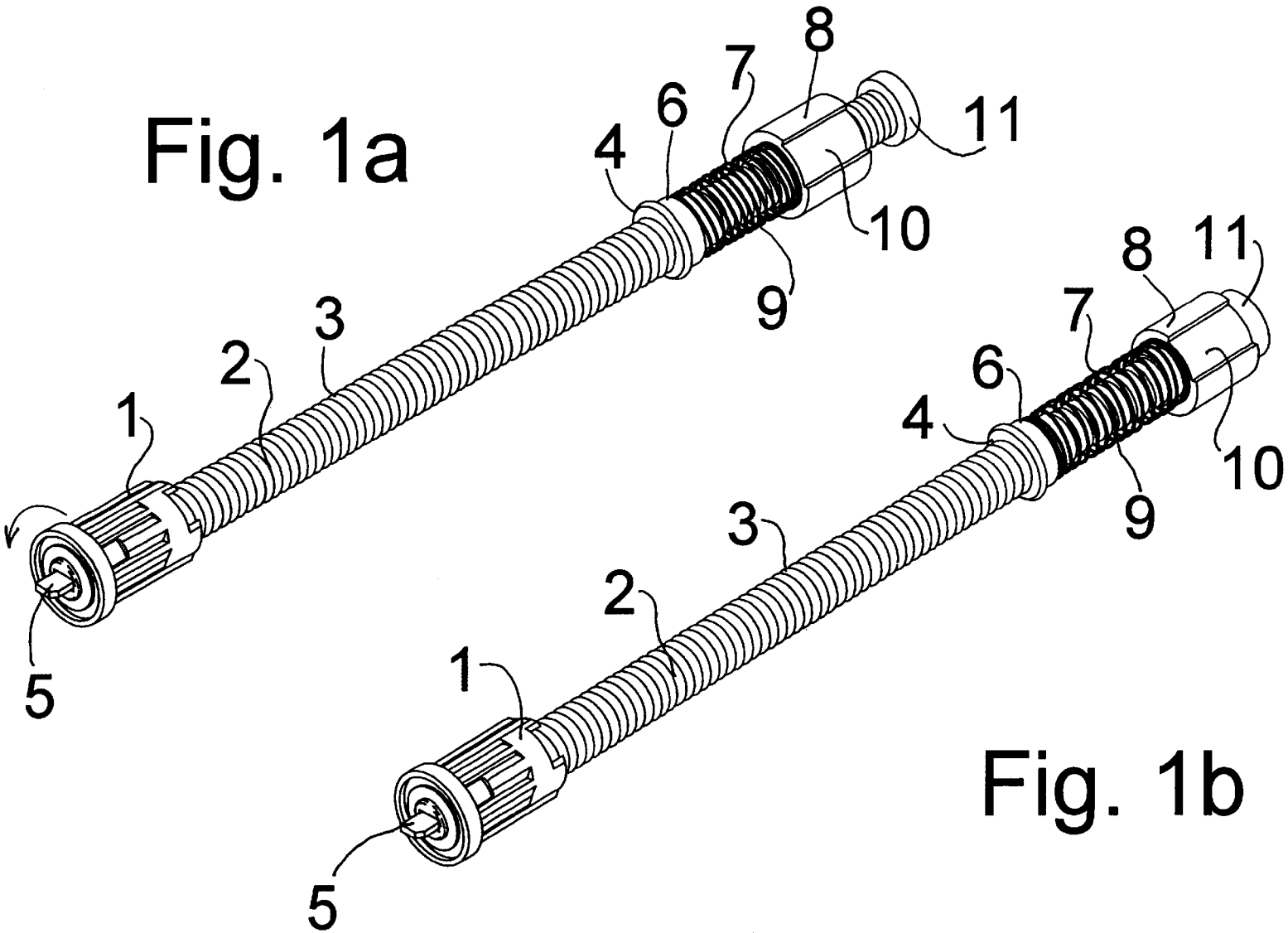

In FIG. 1*a* is seen a mechanism for a roller for a roller blind which is normally fitted inside a tube which is fixed to a rotating bearing part 1. This mechanism consists in particular in a rod 2 around which is fitted a helical raising spring 3. This is fixed between the bearing part 1 and a fixing device 4 on the rod. The end of the rod 2 is available at the outside of the roller in the shape of a projection 5 which is held against rotation by means of a roller blind fixture which is not shown. The other part of the tube is provided with a plug—not shown—and a bearing journal which is free to rotate in a bearing in a second roller blind fitting. The direction of rotation is immaterial for its working principle, but for the sake of the description the present explanation defines that rotation of the tube and the bearing part 1 in the direction of the arrow causes a tensioning of the raising spring 3, i.e. the roller blind is pulled down. In order to lock the roller blind in a desired lowered position, latching devices are fitted in the bearing part 1 which are released by pulling the roller blind and which do not influence the movement as long as the bearing part 1 rotates. The above section also covers the known art.

The side 6 of the fixing device 4 which faces away from the bearing part 1 supports one end of a compression spring 7, the other end of which is supported against a nut 8. This can turn around a thread 9 on the extension of the rod part 2. The nut 8 is provided with one or several grooves 10 which cooperate with a longitudinal tounge in the tube which is not shown because the tube itself is not shown. At the end of the thread 9 an abutment 11 is provided. In FIG. 1*a* is shown a medium position for the roller blind where the raising spring 3 is somewhat tensioned and the nut 8 is at a position somewhat removed from the position corresponding to a completely lowered roller blind as well as from that corresponding to a fully raised roller blind. This latter position is shown in FIG. 1*b*, in which the nut has impacted the abutment 11. In this position there must still remain a certain small tension in the raising spring 3 so that the roller blind is raised with certainty. The invention establishes itself in that the compression spring 7 establishes a force-dependent friction in the connection spring-to-shoulder 6, nut 8 to spring 7, or between the nut 8 and the thread 9. The actual parts which are subjected to the spring force, which shall function as frictional surfaces, are decided by the skilled person based on the choice of materials, as long as the other places have a reduced friction, unless use is made of several friction-determining locations at the same time. Among friction-reducing means may be mentioned PTFE anti-friction foils and ball and roller bearings. Similarly, the location determined as being friction-creating may call for relevant materials based on their coefficient of friction.

Figure 2:
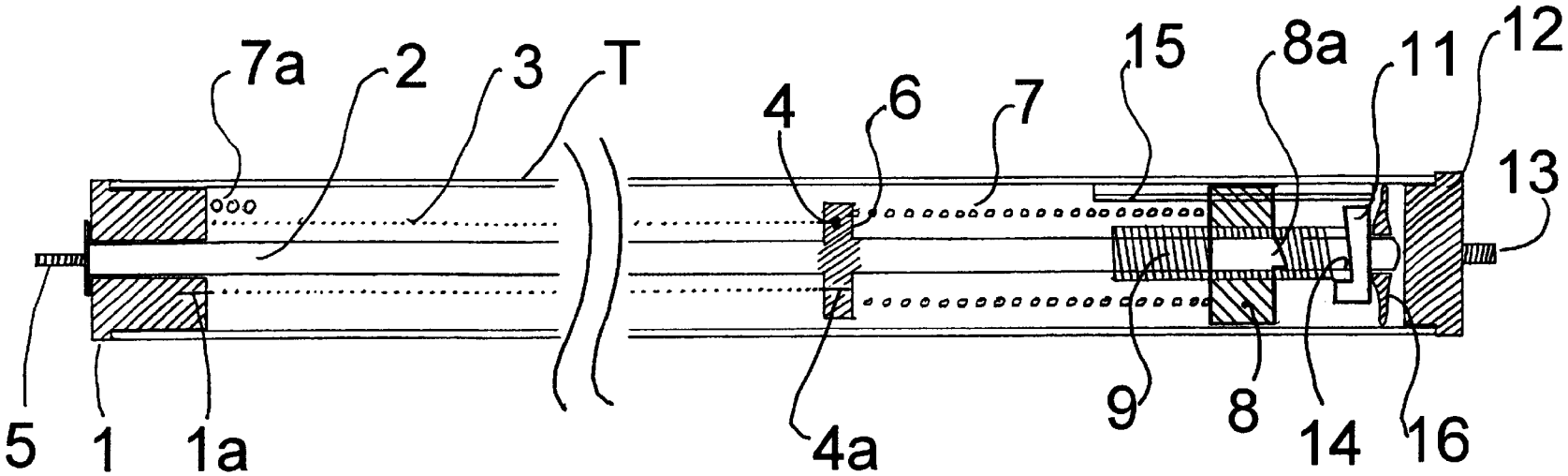
Figures 3A, 3B:
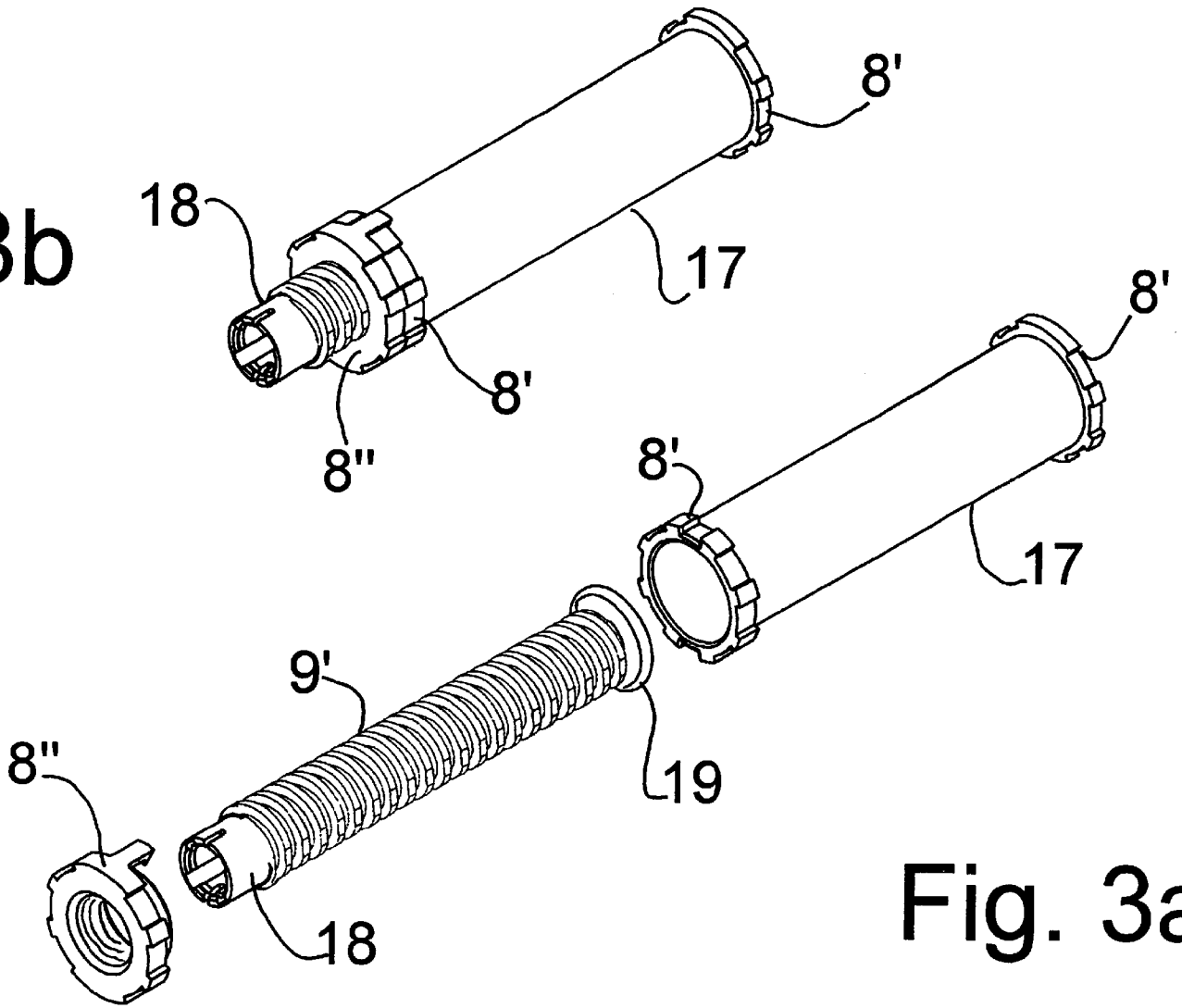
Figure 4:
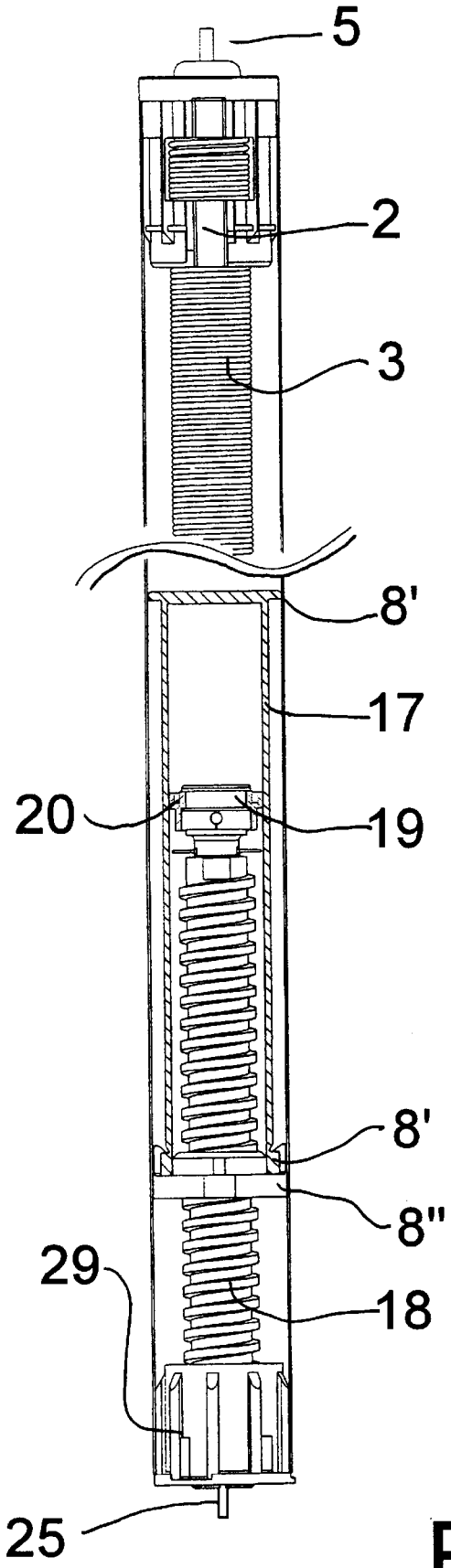
FIG. 4 shows a longitudinal section of the different embodiment that corresponds to FIGS. 3A and 3B.

In FIG. 2 details of the construction are shown, the same reference numerals as above being used. It is shown how the raising spring 3 is fitted to the bearing part 1 at 1*a* and to the fixing means 4 on the rod 2 at 4*a*. Furthermore the surrounding tube T is shown which at the remote end is provided with a plug 12 and a bearing journal 13. It is further seen how the compression spring 7 is fitted between the surface 6 provided on the fixing means 4 and the nut 8. This nut is provided with a projection 8*a* which may abut radially against a similar surface 14 on the abutment 11, in that the nut moves along the thread 9. A tounge 15 ensures that the nut 8 follows the rotation of the tube T because of the groove 10 which is not shown, and a disc 16 functions as a bearing for the free end of the rod 2.

During rotation of the tube T, around which the roller blind is rolled, from the fully raised position and the nut 8 abuts the surface 14, the spring 3 is tensioned by rotation which gives it an increasing torque. Simultaneously the spring 7 is tensioned because the nut moves more and more towards the surface 6 and thereby an increasing braking torque is obtained. These two torques will be adjusted by the skilled person in dependence on friction-creating elements and the pitch of the thread, the number of revolutions from top to bottom, etc. When the centrifugal latching device in the bearing part 1 is released by means of a small tug in the roller blind in its more or less lowered position, the roller blind is raised by the rotation of the tube T. This rotation becomes well controlled, because initially, when the torque is maximum, the rotation is also subjected to the strongest braking action, and later, when the torque is reduced, the braking force is similarly reduced, until a completely precise end to the movement is obtained when the part 8*a* of the nut abuts the part 14 on the abutment 11.

In FIGS. 3A–5B it is shown that a cylinder 17 is rotated because protruding part 8' cooperating with a longitudinal tounge in the roller blind tube T are rotated, whereby a piston containing a piston rod 18 and a piston portion 19, is screwed further and further into the cylinder due to a thread 9', on the piston rod, which cooperates with the cylinder 17 (via the nut 8"). A large similarity will be noted between the nut 8 used in conjunction with compression spring 7 which is relaxed during rotation and the cylinder 17 which during rotation is moved with respect to the piston 18 and 19. It will be realised that there is a considerable freedom for the skilled person to adjust the spring power, not only according to position but also according to the momentary speed with which the roller blind is moved, e.g. forcibly restrained by the user holding on to the string.

The piston 18, 19 is held stationary via a bearing sleeve 29, which is similar to bearing sleeve 1 discussed above, and a projection 25, which is similar to projection 5 discussed above.

Figure 6:
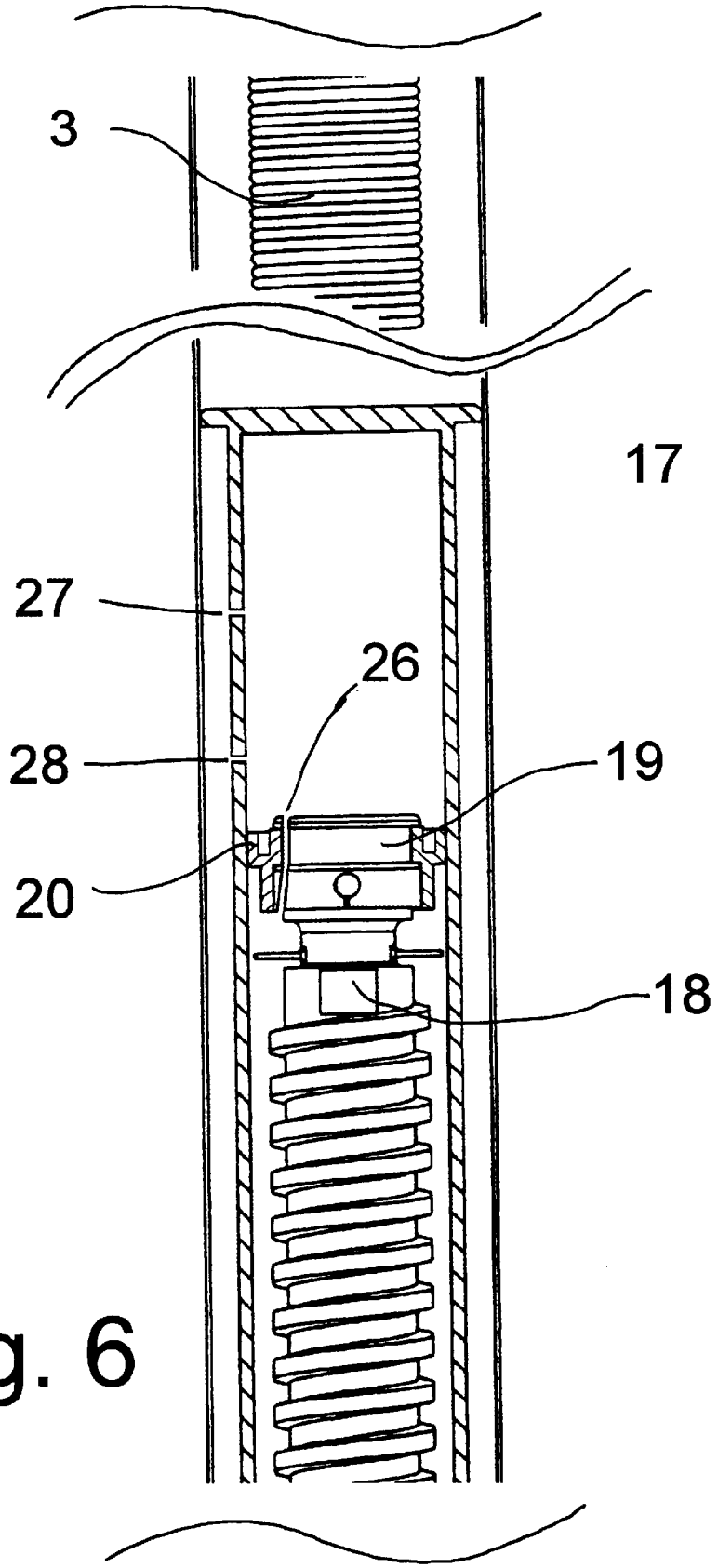
FIG. 6 is an enlarged view of a portion shown in FIG. 4 and shows detail thereat.

The piston packing ring 20 (FIG. 6) may be made in one piece with the piston 18, 19 by means of an injection molding process as shown in the figure, but it may also be made in the form of a separate elastomeric ring which is rolled over the end of the piston at the piston portion 19. The calibrated exhaust opening 26 (see FIG. 6) is in this case an axial groove which passes between the piston packing ring 20 and the piston rod 18.

Also, as mentioned in the summary, exhaust openings 27 and 28 are provided along the surface of the cylinder 17. Thus, as mentioned, the openings 26–28 provide air flow. It is to be appreciated that all of the exhaust opening 26–28 need not be provided. For example, if the packing ring 20 is made one piece with the piston 18, 19, then the exhaust opening 26 would be omitted. Along the same lines, if the exhaust opening 26 is present then the exhaust openings 27 and 28 would be omitted.

A further embodiment according to claim 8 utilises the advantage that one friction-reducing location may be saved, because the spring 7 has been lengthened all the way to the bearing part 1, thereby surrounding the spring 3. This is shown schematically as the spring part 7*a*. In this embodiment the fixing device 4 has a reduced diameter.

Other relative placements of the elements of the present construction are imagineable, e.g. the compression spring and nut may be placed next to the mentioned bearing, and the ordinary raising spring is correspondingly supported between the nut following the rotation and the end of the rod.

A construction which exclusively utilises the friction in threads is constituted with the compression spring fitted between two nuts which are disposed on individual parts of a threaded rod, where one part has a right-hand thread and the other part has a left-hand thread. The combined threaded rod is held against rotation by means of a fixture for the roller blind, and the nuts are rotated by the tube as described above. Threads having a smaller pitch than in the case of a single nut may be used. Correspondingly, two threads in the same direction but with a different pitch may also be used, so that the spring is tensioned due to the difference in pitch. Thereby a lower increase in the spring tension is obtained for the same length of spring as compared to the case of one nut only.

What is claimed is:

1. A winding mechanism for a roller blind, the mechanism including:

a stationary rod (2) held in place by an external fixture;

a tube (T), the stationary rod (2) being located inside the tube (T) and the tube (T) being rotatable on an axis about the stationary rod (2);

a raising spring (3), located inside the tube (T), acting between the tube (T) and the stationary rod (2) to provide a torque on the tube (T) relative to the stationary rod (2) for winding the roller blind onto the tube (T);

a non-rotating threaded piston rod (18) fixed relative to the stationary rod (2) and being located inside the tube (T), the piston rod (18) having a threaded portion (9') and a piston portion (19); and a cylinder (17), located inside the tube (T), operatively connected to the tube (T) for rotation with the tube (T) and operatively cooperating with the threaded portion (9') for rotational and axial movements of the cylinder (17) relative to the piston rod (18) during rotation of the tube (T) to act upon air bounded within the cylinder (17) by the piston portion (19) of the piston rod (18).

2. A winding mechanism according to claim 1, wherein the cylinder (17) is provided with at least one opening for controlled, pressure dependent exhaust of air during axial movement of the cylinder (17) relative to the piston rod (18).

3. A winding mechanism according to claim 1, wherein the stationary rod (2) and the piston rod (18) are two separate parts, a nut (8") is engaged with the threaded portion (9') of the piston rod (18) and rotated with the tube (T) and the cylinder (17).

4. A winding mechanism according to claim 2, wherein the opening (e.g., 27) is through the cylinder (17).

5. A winding mechanism according to claim 2, wherein the opening (e.g., 26) is through the piston portion (19).

6. A winding mechanism according to claim 2, wherein the exhaust of air occurs during axial movement of the cylinder (17) relative to the piston rod (18) in a first direction, during axial move of the cylinder (17) relative to the piston rod (18) in a second direction air is sucked into the cylinder (17).

* * * * *

UNITED STATES PATENT AND TRADEMARK OFFICE

CERTIFICATE OF CORRECTION

PATENT NO. : 6,467,714 B1
DATED : October 22, 2002
INVENTOR(S) : Ken Rasmussen

It is certified that error appears in the above-identified patent and that said Letters Patent is hereby corrected as shown below:

Title page,
Item [30], Foreign Application Priority Data, please delete the following reference: "Jan. 9, 1998 (DK) 0023/98", and insert therefor
-- Jan. 12, 1998 (DK) 0023/98 --.

Column 6,
Lines 57 and 59, please delete "e.g.,".

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,467,714 B1
DATED : October 22, 2002
INVENTOR(S) : Ken Rasmussen

It is certified that error appears in the above-identified patent and that said Letters Patent is hereby corrected as shown below:

Column 6,
Lines 58 and 60, please delete “e.g.,”.

Signed and Sealed this

Twenty-seventh Day of May, 2003

JAMES E. ROGAN
*Director of the United States Patent and Trademark Office*